United States Patent [19]

Lilienfein

[11] Patent Number: 4,731,954

[45] Date of Patent: Mar. 22, 1988

[54] METHOD AND APPARATUS FOR INITIATING AN OPERATION FOR DRESSING A GRINDING WHEEL IN CONFORMITY WITH ITS DEGREE OF BLUNTNESS

[75] Inventor: Ulrich Lilienfein, Stuttgart, Fed. Rep. of Germany

[73] Assignee: Fortuna-Werke Maschinenfabrik Gesellschaft mit beschränkter Haftung, Stuttgart, Fed. Rep. of Germany

[21] Appl. No.: 896,386

[22] Filed: Aug. 13, 1986

[30] Foreign Application Priority Data

Aug. 16, 1985 [DE] Fed. Rep. of Germany ..... 3529427

[51] Int. Cl.[4] ..... B24B 49/16

[52] U.S. Cl. ..... 51/165.71; 51/165.88; 51/281 R; 51/325; 125/11 R

[58] Field of Search ..... 51/165.87, 165.88, 165 B, 51/165.71, 281 R, 325; 125/11 R

[56] References Cited

U.S. PATENT DOCUMENTS

| | | | |
|---|---|---|---|
| 3,760,539 | 9/1973 | Robillard | 51/165.88 |
| 3,973,433 | 8/1976 | Pozzetti | 51/165.88 |
| 4,018,010 | 4/1977 | Pozzetti et al. | 51/165.88 |
| 4,053,289 | 10/1977 | Tatsumi | 51/165.88 |

FOREIGN PATENT DOCUMENTS

| | | | |
|---|---|---|---|
| 457587 | 3/1975 | U.S.S.R. | 51/165.88 |
| 442044 | 4/1975 | U.S.S.R. | 51/165.88 |
| 604665 | 4/1978 | U.S.S.R. | 51/165.88 |

*Primary Examiner*—Harold D. Whitehead

*Attorney, Agent, or Firm*—Becker & Becker, Inc.

[57] ABSTRACT

In the method for introducing an operation for dressing a grinding wheel, an actual differential value is formed from its infeed distance and the material removed from a workpiece, which value is compared with a desired differential value. As soon as the actual differential value is at least equal to the desired differential value, a signal for dressing the grinding wheel is generated. The grinding wheel can be used for the optimum length of time, because the actual degree of bluntness of the grinding wheel is taken into consideration in the measurement. The grinding wheel is seated on a feed carriage, the infeed distance of which is monitored by a measuring device. A further measuring device is provided for measuring the material removed from the workpiece. Both measuring devices are connected via a signal line respectively to a computer for a comparison of the desired value and actual value. The computer is provided with an output signal.

4 Claims, 5 Drawing Figures

FIG. 1
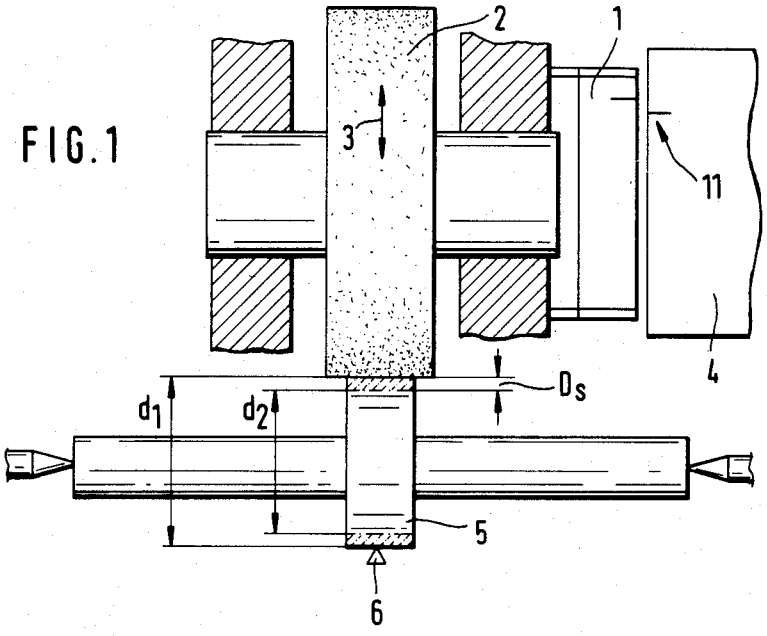
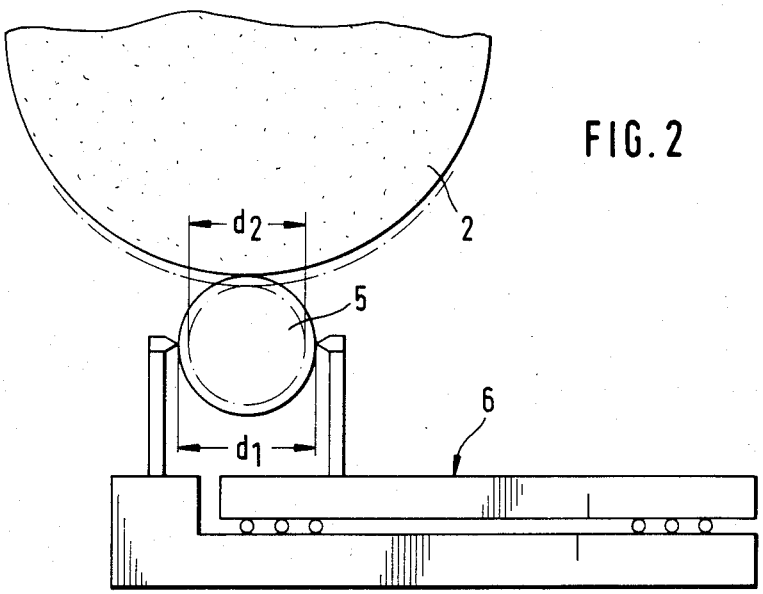
FIG. 2

METHOD AND APPARATUS FOR INITIATING AN OPERATION FOR DRESSING A GRINDING WHEEL IN CONFORMITY WITH ITS DEGREE OF BLUNTNESS

BACKGROUND OF THE INVENTION

1. Field of the Invention

The present invention relates to a method for initiating an operation for dressing a grinding wheel in conformity with its degree of bluntness, with said grinding wheel being infed towards the workpiece that is to be machined thereby. The present invention also relates to an apparatus for carrying out a method of this type.

2. Description of the Prior Art

In program-controlled grinding machines, it is known to move the grinding wheel towards the workpiece to be machined, and to then carry out grinding. During the machining process, the material removed from the workpiece is measured by a measuring device on a multi-range absolute head, and the infeed distance of the grinding wheel is measured by a distance measuring system. It is possible to calculate from the measurement data when the machining of the workpiece is finished and when the machining operation can be discontinued. Since the grinding wheel is subject essentially to bluntness, that is in effect subject to a reduction in the cutting capacity, due to clogging with particles of dirt and the like, from time to time the wheel must be dressed. Normally the dressing operation is carried out after a predetermined number of machining operations or after a predetermined number of workpieces. In order to ensure that the grinding wheel does not become too blunt before the next dressing operation, the dressing operations are carried out at relatively short intervals. Consequently, the grinding wheel is not utilized in an optimum manner, because the actual bluntness of the grinding wheel is not taken into consideration. The grinding wheel is dressed when the abrasive grains are not yet blunt to the optimum degree; in other words, further machining operations could have been carried out before the dressing operation.

It is an object of the present invention to design the method and apparatus of the aforementioned general type in such a way that the bluntness of the grinding wheel can be determined in a simple manner during machining, so that the grinding wheel can be dressed with optimum conformation to the degree of bluntness.

SUMMARY OF THE INVENTION

In the method according to the present invention, the actual differential value is formed from the infeed distance of the grinding wheel and the amount of material removed from the workpiece, whereupon this value is compared with the desired differential value. As long as the actual differential value is less than the desired differential value, the grinding wheel is still sufficiently sharp, so that it is possible to carry on machining with the latter. The cutting capacity of the abrasive grains in the grinding wheel has thus not yet been reduced prohibitively.

As the degree of bluntness increases, the grinding wheel must be pressed more firmly against the workpiece. The workpiece and/or the superstructure of the apparatus bends under the contact pressue. The grinding wheel must therefore be readjusted by this amount. However, due to this, the entire infeed distance of the grinding wheel, becomes greater, until final machining of the workpiece. Consequently, the actual differential value likewise becomes greater. As soon as this value is equal to the desired differential value, the dressing signal is generated. The grinding wheel then has such a high degree of bluntness that it must be dressed. Thus, with the method according to the present invention, the grinding wheel can be used for the optimum length of time, because the actual degree of bluntness of the grinding wheel is taken into consideration in the measurement, and the cutting capacity of the abrasive grains is utilized in an optimum manner.

The degree of bluntness of the grinding wheel can be determined easily with the apparatus according to the present. When machining the workpiece with the grinding wheel, the material removed from the workpiece, and the infeed distance of the grinding wheel, are monitored by measuring devices and are supplied as signals, via the lines, to the computer. The latter ascertains the actual difference of the signals supplied and compares this with the stored desired differential value. As soon as the actual differential value is equal to or greater than the desired differential value, a signal is sent via the output signal line of the computer; i.e. the signal from the computer is used generally for initiating the dressing operation directly (automatically). The user of the inventive apparatus is then informed that the grinding wheel must now be dressed.

Further features of the invention will become apparent from the other claims, the specification, and the drawings.

BRIEF DESCRIPTION OF THE DRAWINGS

The invention will be described in detail with reference to one exemplary embodiment illustrated in the drawings, in which:

FIG. 1 is a diagrammatic plan view of the apparatus according to the present invention;

FIG. 2 is a diagrammatic elevational view of the apparatus according to the present invention;

DESCRIPTION OF PREFERRED EMBODIMENTS

Figure 4:
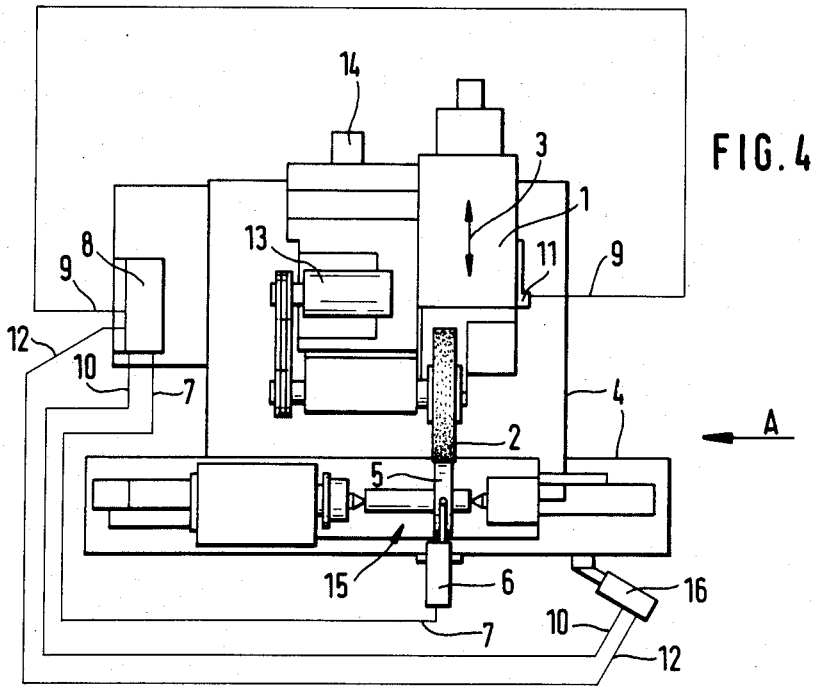
FIG. 4 is a plan view that shows the apparatus according to the present invention.
Figure 5:
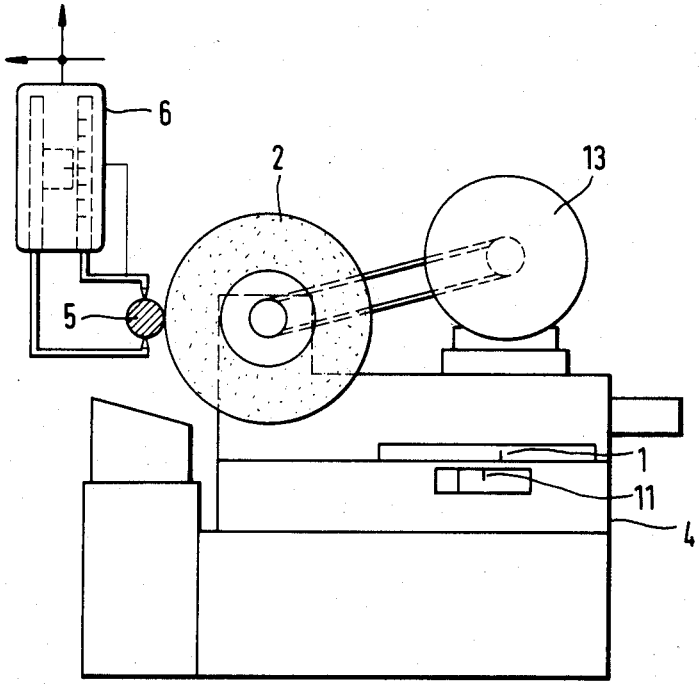
FIG. 5 is a view that shows the apparatus according to the present invention in elevation in the direction of arrow A of FIG. 4.

The apparatus has a carriage 1 with which a tool 2, in this embodiment a grinding wheel, can be moved in the direction of the double arrow 3. The tool 2 is rotated by a motor 13 (FIGS. 4 and 5) in known manner; this motor is likewise located on the carriage 1. The carriage 1 is seated on a machine bed or base 4, and is driven in known manner by a motor 14. A workpiece 5 to be machined is clamped in a clamping device 15 (FIG. 4). Before machining with the tool 2, the workpiece 5, which in the embodiment has a circular cross-section, has a diameter $d_1$, and is ground to the final dimension $d_2$ by the tool. The diameter of the workpiece 5 at any given time is measured during machining by a measuring device 6, which is a known distance measuring system on a multi-range absolute measuring head. The directions of movement of the measuring device 6 are indicated by arrows in FIG. 5.

Figure 3:
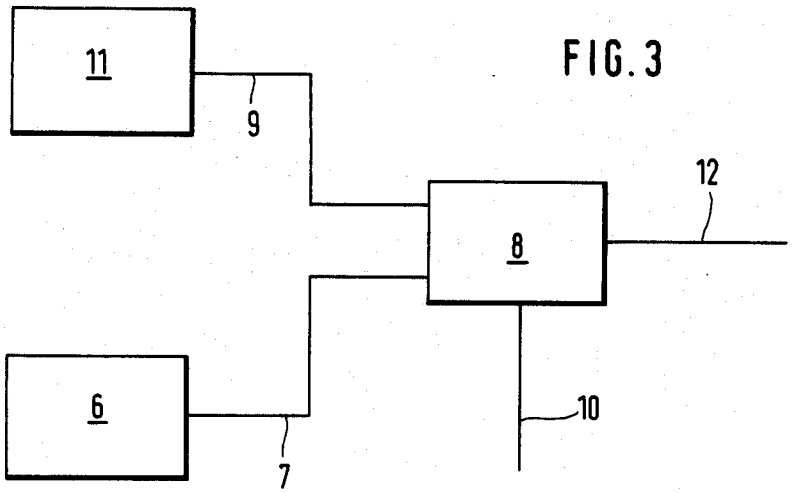
FIG. 3 is a view that shows a block circuit diagram of a device for displaying when the grinding wheel of the inventive apparatus needs to be dressed.

The measuring device 6 is connected by a line 7 to a computer 8 (FIGS. 3 and 4), which is expediently located on the machine bed 4.

The carriage 1 with the tool 2 is moved on the machine bed 4, with the infeed distance $D_s$ of the tool being measured by a further measuring device 11. The latter is a distance measuring system known per se, and is provided on the grinding carriage 1. The infeed distance $D_s$ at any given time is likewise fed, as a signal, to the computer 8 via a line 9. A line 10 for the input of a desired value is also connected to the computer 8.

Since material is removed by grinding during the machining of the workpiece 5, its diameter decreases from the dimension $d_1$ to the final dimension $d_2$. The carriage 1 with the tool 2 must be moved in the feed direction 3 in conformity with the reduction in the diameter of the workpiece 5.

If it is assumed that the tool 2 is sharp and during machining no deflection movements of the apparatus and of the workpiece occur under the pressure of the tool, then the carriage 1 is adjusted in such a way that the measuring device 11 displays the value 0, for example, when the machining of the workpiece 5 to the final dimension $d_2$ is completed. The measuring device 6 is thus pre-set so that it then likewise displays the value 0. However, these ideal conditions do not occur in practice. Over a period of time, the grinding wheel 2 becomes clogged with particles of dirt and the like and become blunt. The degree of bluntness of the grinding wheel 2 is a measure of the cutting capacity of the grinding wheel 2. As the degree of bluntness increases, i.e. the more the grinding wheel 2 becomes clogged with particles of dirt, the more the grinding wheel has to be pressed against the workpiece 5 in order to achieve removal of material. The workpiece 5 and the superstructure of the apparatus bend under this increased contact pressure. The grinding wheel 2 must therefore be moved with the carriage 1 by the corresponding amount. The measuring device 11 thus already registers an infeed distance $D_s$. In this case, the diameter $d_1$ of the workpiece 5 has not yet altered, since material has not yet been removed, so that the measuring device 6 still displays the initial value.

During the subsequent grinding operation, the carriage 1 is readjusted in conformity with removal of material from the workpiece 5 until the measuring device 6 displays the predetermined measured value, in this example the value 0. The workpiece 5 then has the required finished diameter $d_2$, so that the grinding wheel 2 is returned for exchange of the workpiece. During infeed of the grinding wheel 2, the measuring device 11 displays the infeed distance $D_s$ at any given time.

During the grinding operation, the respective infeed distance $D_s$ of the carriage 1, i.e. of the grinding wheel 2, and the respective actual diameter $d_{act}$ of the workpiece 5 are fed, in the form of signals, by the measuring devices 6 and 11, continuously or at predetermined intervals, via the lines 7 and 9 to the computer 8. The difference $\Delta D_{act}=D_s-d_{act}$ is formed from these actual values in the computer 8 and is compared with a desired value $\Delta D_{des}$, which can be fed into the computer 8 via the line 10. As long as the condition $\Delta D_{act}<\Delta D_{des}$ is met, the degree of bluntness of the grinding wheel 2 is still low enough that the wheel can be used for the next machining operation.

As the degree of bluntnes of the grinding wheel 2 increases, the contact pressure necessary for removing material from the workpiece 5 increases, so that the workpiece and/or the apparatus superstructure increasingly bend or bow. With a given removal of material from the workpiece $d_1-d_2$, the infeed distance $D_s$ of the carriage 1 thus continues to increase, so that the differential dimension $\Delta D_{act}=D_s-d_{act}$ becomes greater for each machining operation. The desired dimension $\Delta D_{des}$ is now selected in such a way that the grinding wheel 2 must be dressed when the condition $\Delta D_{act}\geqq\Delta D_{des}$. The computer 8 then sends a signal by way of an output signal line 12, which signal can be supplied to an indicator or display 16. Thus, the output signal line 12 leads from the computer 8 to feed the output signal to the indicator or display means 16 for indicating that it is necessary to dress the grinding wheel 2. In apparatus where the grinding wheel 2 can be dressed automatically, the output signal can be used to initiate this automatic dressing operation after machining of the workpiece 5 is completed.

As a result of the afore-described method, the degree of bluntness of the tool 2 at any given time is taken into consideration, so that it is only dressed when this is actually necessary. With this method it is thus possible to work substantially more economically than with known methods, in which the tool is dressed solely after a given number of machining operations, without taking the actual degree of bluntness into consideration.

The present invention is, of course, in no way restricted to the specific disclosure of the specification and drawings, but also encompasses any modifications within the scope of the appended claims.

I claim:

1. A method of initiating an operation for dressing a grinding wheel as a function of its degree of bluntness, with said grinding wheel being infed towards a workpiece that is to be machined thereby, said method including the steps of:

necessarily forming an actual differential value from the infeed distance of said grinding wheel and the material removed from said workpiece;

then comparing said actual differential value with a desired differential value; and when said actual differential value based upon infeed distance and material removed from said workpiece > said desired differential value, finally generating a signal in a computer which determines differential value increments for dressing said grinding wheel so that the dressing of said grinding wheel is undertaken only when this is actually necessary.

2. A method according to claim 1, which includes the steps of constantly measuring said actual differential value during machining, and constantly comparing this value with said desired differential value.

3. An apparatus for initiating an operation for dressing a grinding wheel as a function of its degree of bluntness, with said grinding wheel being infed towards a workpiece that is to be machined thereby, said apparatus further comprising:

a feed carriage that supports said grinding wheel;

means for holding said workpiece;

a first measuring device for measuring material removed from said workpiece;

a second measuring device for measuring the infeed distance of said feed carriage;

respective signal lines leading from said first and second measuring devices;

a computer to which said signal lines feed, with said computer serving for comparison of actual and desired differential values based upon infeed distance and material removed from said workpiece; and an output signal leading from said computer for indicating that it is actually necessary to dress said grinding wheel.

4. An apparatus according to claim 3, which includes display means to which said output signal line feeds.

* * * * *